US009979152B2

(12) United States Patent
Zhang et al.

(10) Patent No.: US 9,979,152 B2
(45) Date of Patent: May 22, 2018

(54) ELECTRICAL CONNECTOR HAVING IMPROVED CONTACT MODULE AND METHOD FOR MAKING SAME

(71) Applicant: FOXCONN INTERCONNECT TECHNOLOGY LIMITED, Grand Cayman (KY)

(72) Inventors: Jian-Li Zhang, HuaiAn (CN); Jing-Jie Guo, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days. days.

(21) Appl. No.: 15/174,001

(22) Filed: Jun. 6, 2016

(65) Prior Publication Data

US 2016/0359274 A1 Dec. 8, 2016

(30) Foreign Application Priority Data

Jun. 5, 2015 (CN) ..... 2015 1 0301712

(51) Int. Cl.
*H01R 13/405* (2006.01)
*H01R 43/24* (2006.01)
(Continued)

(52) U.S. Cl.
CPC ..... *H01R 43/24* (2013.01); *H01R 13/405* (2013.01); *H01R 13/6581* (2013.01);
(Continued)

(58) Field of Classification Search
CPC ..... H01R 13/405; H01R 13/648; H01R 13/6581; H01R 13/6587; H01R 23/7073; H01R 23/02
(Continued)

(56) References Cited

U.S. PATENT DOCUMENTS

| | | | | |
|---|---|---|---|---|
| 2010/0248517 | A1 | 9/2010 | Hai | |
| 2013/0178110 | A1 | 7/2013 | Xie et al. | |
| 2014/0065889 | A1 | 3/2014 | Zhang et al. | |
| 2015/0207257 | A1 | 7/2015 | Dai et al. | |
| 2016/0020568 | A1* | 1/2016 | Ju | H01R 24/78 439/607.01 |

FOREIGN PATENT DOCUMENTS

| | | |
|---|---|---|
| CN | 201904481 | 7/2011 |
| CN | 102856684 | 1/2013 |

(Continued)

*Primary Examiner* — Abdullah Riyami
*Assistant Examiner* — Justin Kratt
(74) *Attorney, Agent, or Firm* — Wei Te Chung; Ming Chieh Chang

(57) ABSTRACT

An electrical connector includes an insulative housing, a number of contacts, a shielding plate, and a metallic shell. The insulative housing defines a number of contact-receiving grooves and a number of through holes connecting with adjacent contact-receiving grooves. The contacts include a number of first contacts having connecting sections, at least one connecting section of the first contacts has a first bending section bent along a direction away from the contiguous first contact to form an enlarged gap for increasing a distance between the adjacent first contacts. The insulative housing, the shielding plate and the contacts are molded to form a contact module. The enlarged gap and the corresponding through hole are connected together.

18 Claims, 12 Drawing Sheets

(51) Int. Cl.

| | |
|---|---|
| ***H01R 13/6581*** | (2011.01) |
| ***H01R 13/6593*** | (2011.01) |
| ***H01R 43/16*** | (2006.01) |
| *H01R 12/50* | (2011.01) |
| *H01R 24/00* | (2011.01) |
| *H01R 13/6587* | (2011.01) |
| *H01R 13/648* | (2006.01) |

(52) U.S. Cl.
CPC ..... *H01R 13/6593* (2013.01); *H01R 43/16* (2013.01); *H01R 13/648* (2013.01); *H01R 13/6587* (2013.01); *H01R 23/02* (2013.01); *H01R 23/7073* (2013.01)

(58) Field of Classification Search
USPC ..... 439/660, 676, 607.55, 607.57, 607.58
See application file for complete search history.

(56) References Cited

FOREIGN PATENT DOCUMENTS

| | | | |
|---|---|---|---|
| CN | 103296510 | | 9/2013 |
| CN | 203631831 | | 6/2014 |
| CN | 203859329 | | 10/2014 |
| CN | 203859329 U | * | 10/2014 |
| CN | 203942066 | | 11/2014 |
| CN | 204179333 | | 2/2015 |
| CN | 204289872 | | 4/2015 |
| CN | 204333335 | | 5/2015 |
| CN | 204333335 U | * | 5/2015 |
| TW | M466370 | | 11/2013 |
| TW | M501018 | | 5/2015 |

* cited by examiner

20

ELECTRICAL CONNECTOR HAVING IMPROVED CONTACT MODULE AND METHOD FOR MAKING SAME

BACKGROUND OF THE INVENTION

1. Field of the Invention

The present invention relates generally to an electrical connector, and more particularly to an electrical connector adapted for normally and reversely mating with a mating connector and a method of making the same.

2. Description of Related Arts

U.S. Patent Publication No. 2014/0065889, published on Mar. 3, 2014, discloses an insulative body defining a plurality of contact receiving grooves, a plurality of contacts disposed in the contact receiving grooves, and a plurality of bridge portions positioned between adjacent contacts. The insulative body includes a plurality of openings to expose the bridge portions, which assists in cutting and removal of the bridge portions through the openings.

An improved electrical connector is desired.

SUMMARY OF THE INVENTION

An object of the present invention is to provide an electrical connector which is easy to make.

To achieve the above-mentioned object, an electrical connector includes: an insulative housing comprising a base portion, a tongue portion extending forwardly from the base portion along an insertion direction, a plurality of cavities extending through the tongue portion in an up-to-down direction perpendicular to the insertion direction, and a plurality of contact-receiving grooves, the cavities comprising a plurality of through holes connecting with the adjacent contact-receiving grooves; a plurality of contacts comprising a plurality of first contacts accommodated in the contact-receiving grooves, each contact comprising an engaging section, a soldering section, and a connecting section connecting the engaging section and the soldering section, at least one connecting section of the first contacts comprising a first bending section bent along a direction away from the contiguous first contact to form an enlarged gap for increasing a distance between corresponding adjacent first contacts; a shielding plate accommodated in the insulative housing; and a metallic shell enclosing the insulative housing; wherein the insulative housing, the shielding plate, and the contacts are insert-molded to form a contact module, and the enlarged gap and corresponding through hole are connected together in the up-to-down direction.

Other objects, advantages and novel features of the invention will become more apparent from the following detailed description when taken in conjunction with the accompanying drawings.

DETAILED DESCRIPTION OF THE PREFERRED EMBODIMENT

Figure 1:
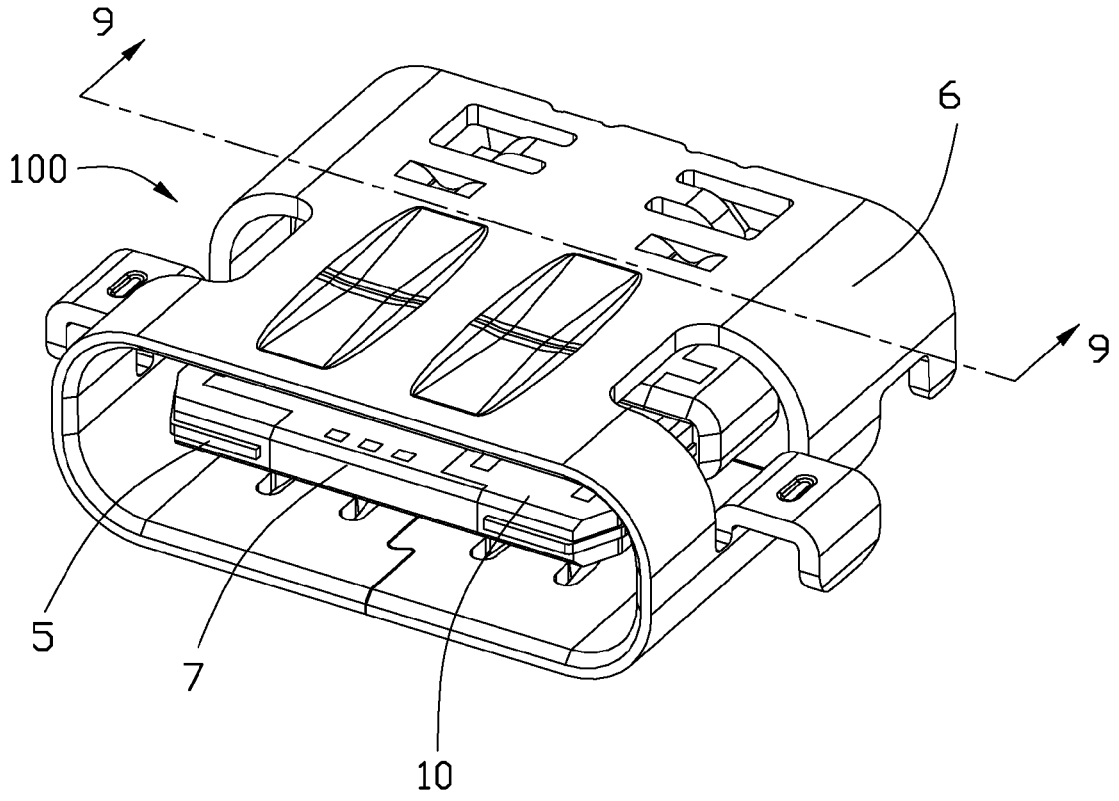
FIG. 1 is a perspective, assembled view of an electrical connector in accordance with the present invention.
Figure 2:
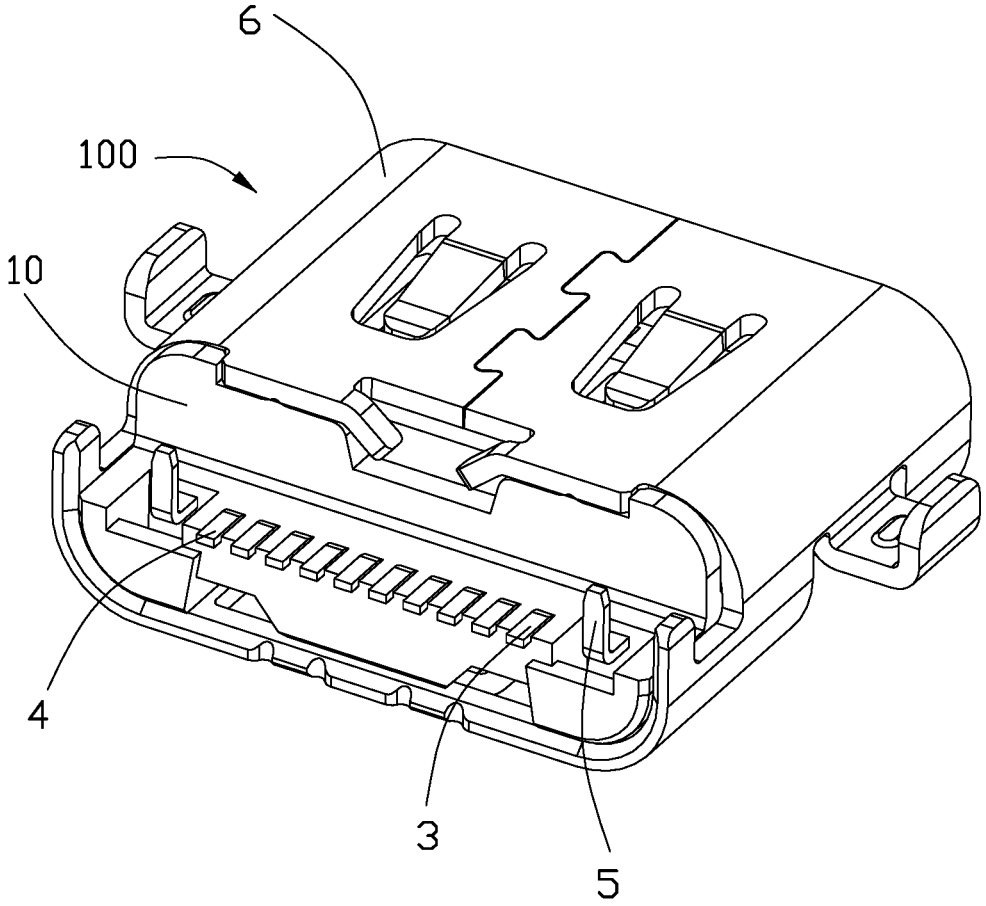
FIG. 2 is another perspective view of the connector shown in FIG. 1.
Figure 3:
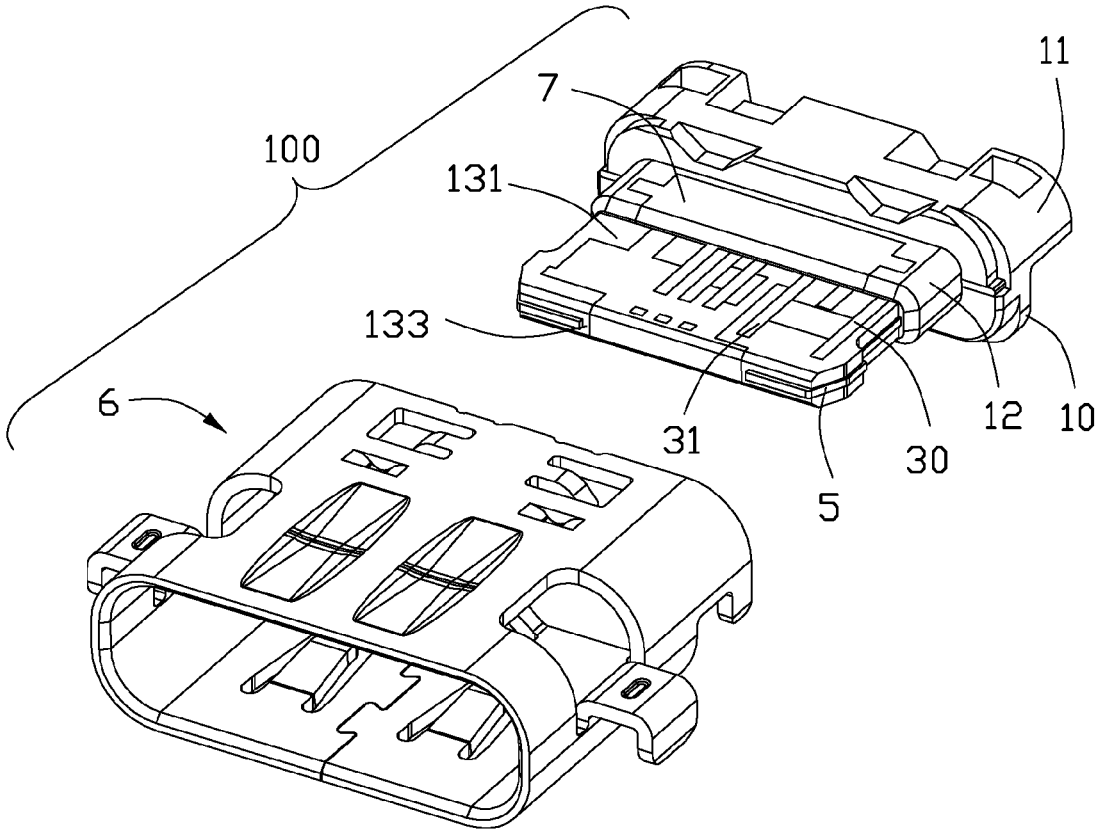
FIG. 3 is a partially exploded view of the connector shown in FIG. 1.

Referring to FIGS. 1-12, an electrical connector 100 in accordance with the present invention comprises an insulative housing 10 defining a plurality of cavities 2, a plurality of contacts 3 accommodated in the insulative housing 10, a shielding plate 5 accommodated in the insulative housing 10, a metallic shell 6 enclosing the insulative housing 10, and an insulative member 7 attached to the insulative housing 10. The insulative housing 10, all the contacts 3 and the shielding plate 5 are molded to form a contact module 20 by a first insert-molding process. The insulative member 7 is further attached to the contact module 20 by a second-insert molding process for sealing the cavities 2.

As shown in FIGS. 3-9, the insulative housing 10 comprises a main portion 11 and a tongue portion 12 extending forwardly from the main portion 11 along an insertion direction. The tongue portion 12 defines an upper surface 131, an lower surface 132, a front surface 133 and a plurality of contact-receiving grooves 120 receiving the contacts 3 and the cavities 2 extend through the tongue portion 12 in an up-to-down direction perpendicular to the insertion direction.

As shown in FIGS. 3-9 and 11-12, the contacts 3 comprise a plurality of first contacts 30 in the upper row and a plurality of second contacts 40 in the lower row. Each contact comprises an engaging section exposed on the tongue portion 12, a soldering section exposed out of a rear end of the main portion 11, and a connecting section connecting the engaging section and the soldering section. The engaging sections of first contacts 30 and the second contacts 40 are positioned on the upper surface 131 and the lower surface 132 correspondingly for being normally and reversely mating with a mating connector (not shown). The soldering sections of the first contacts 131 and the second contacts 132 are arranged in a row.

Each first contact 30 comprises a first engaging section 31 exposed on the upper surface 131, a first soldering section 32 exposed out of the rear end of the main portion 11, and a first connecting section 33 connecting the first engaging section 31 and the first soldering section 32. The first connecting section 33 comprises a first bending section 35 bent along a direction away from a contiguous first contact to form the enlarged gap 8 for increasing a distance between the two adjacent first contacts 30. Each first engaging section 31 comprises a first forestalling section 34 located in a front thereof and fixed in the tongue portion 12 for preventing the first contact 30 from warping.

Figure 4:
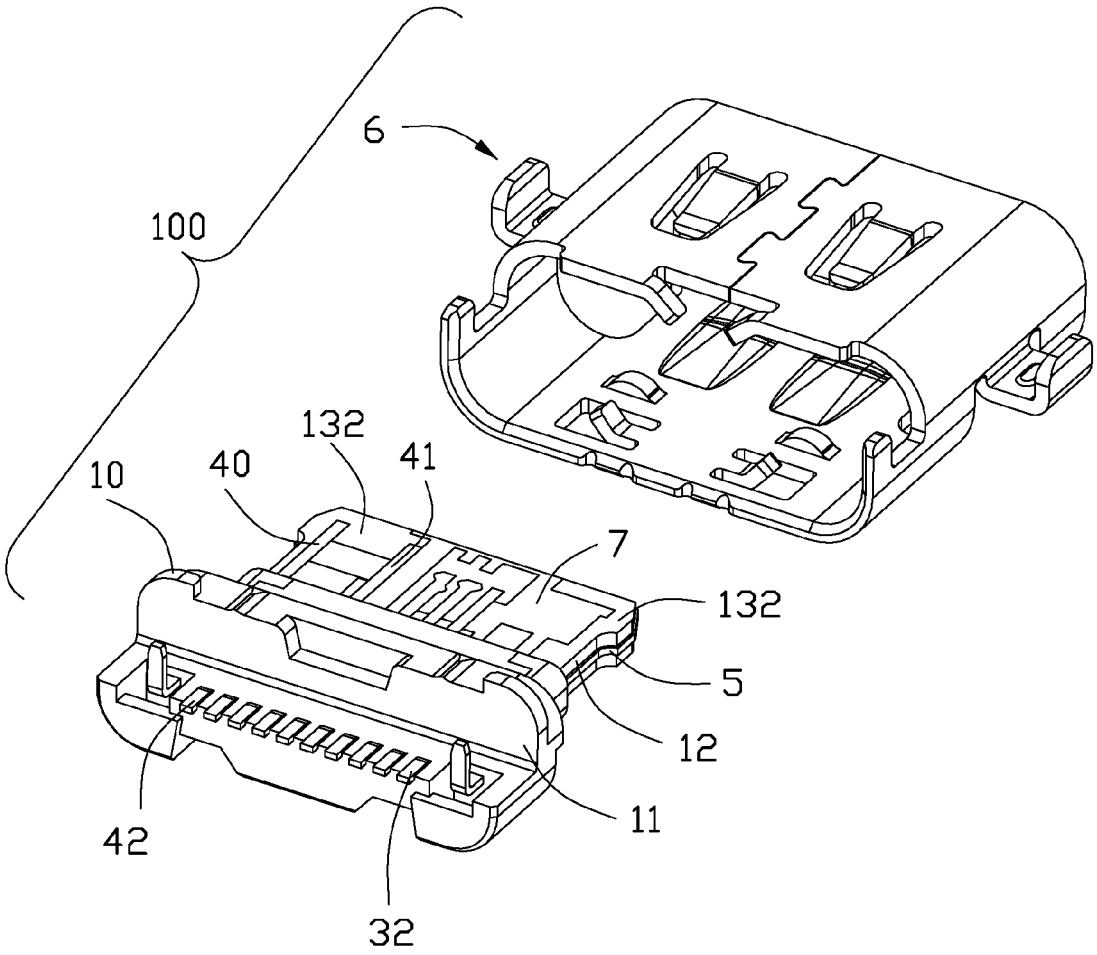
FIG. 4 is a view similar to FIG. 3, but viewed from another aspect.
Figure 5:
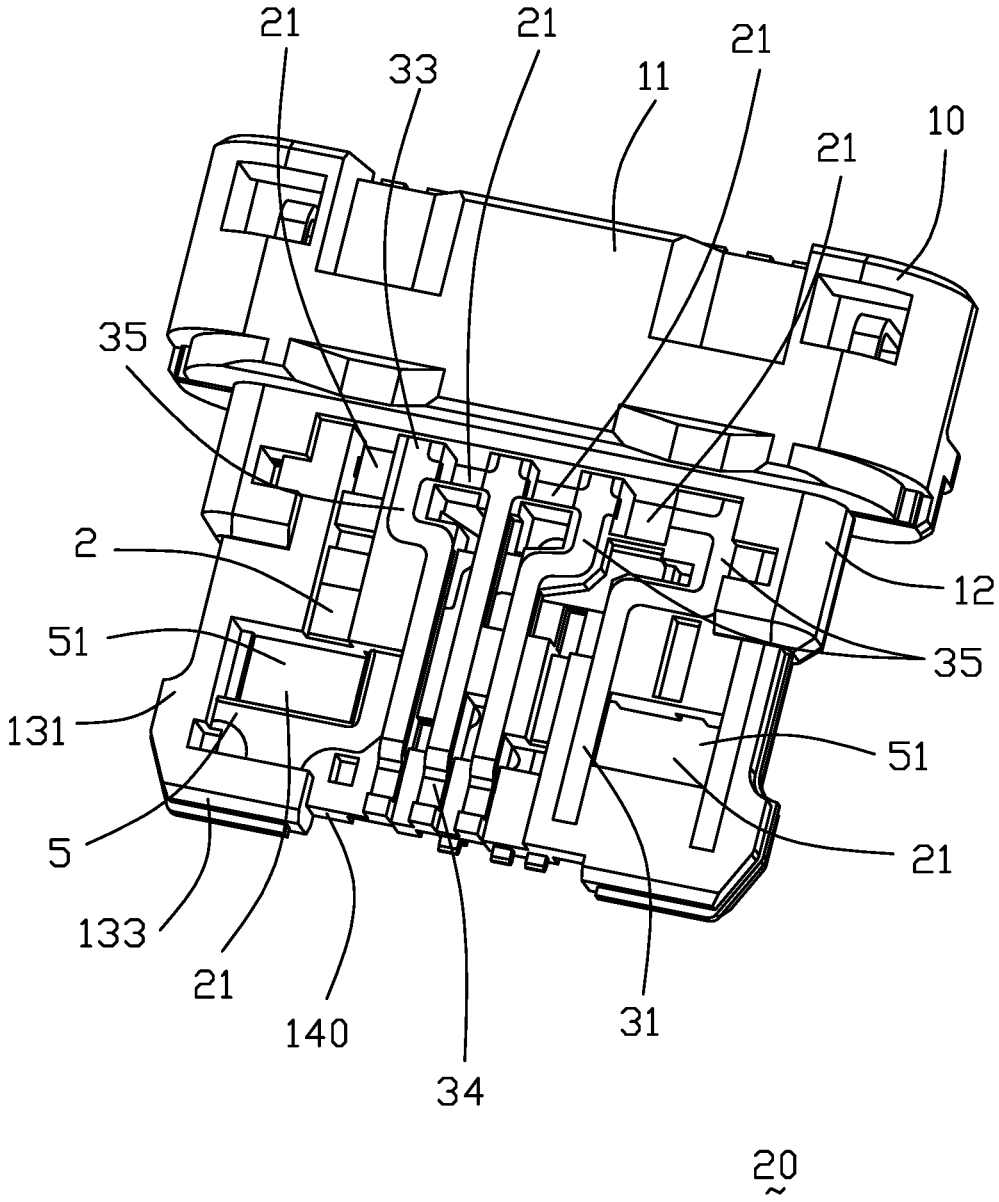
FIG. 5 is a perspective view of the connector shown in FIG. 1 omitting a metallic shell and an insulative member.
Figure 6:
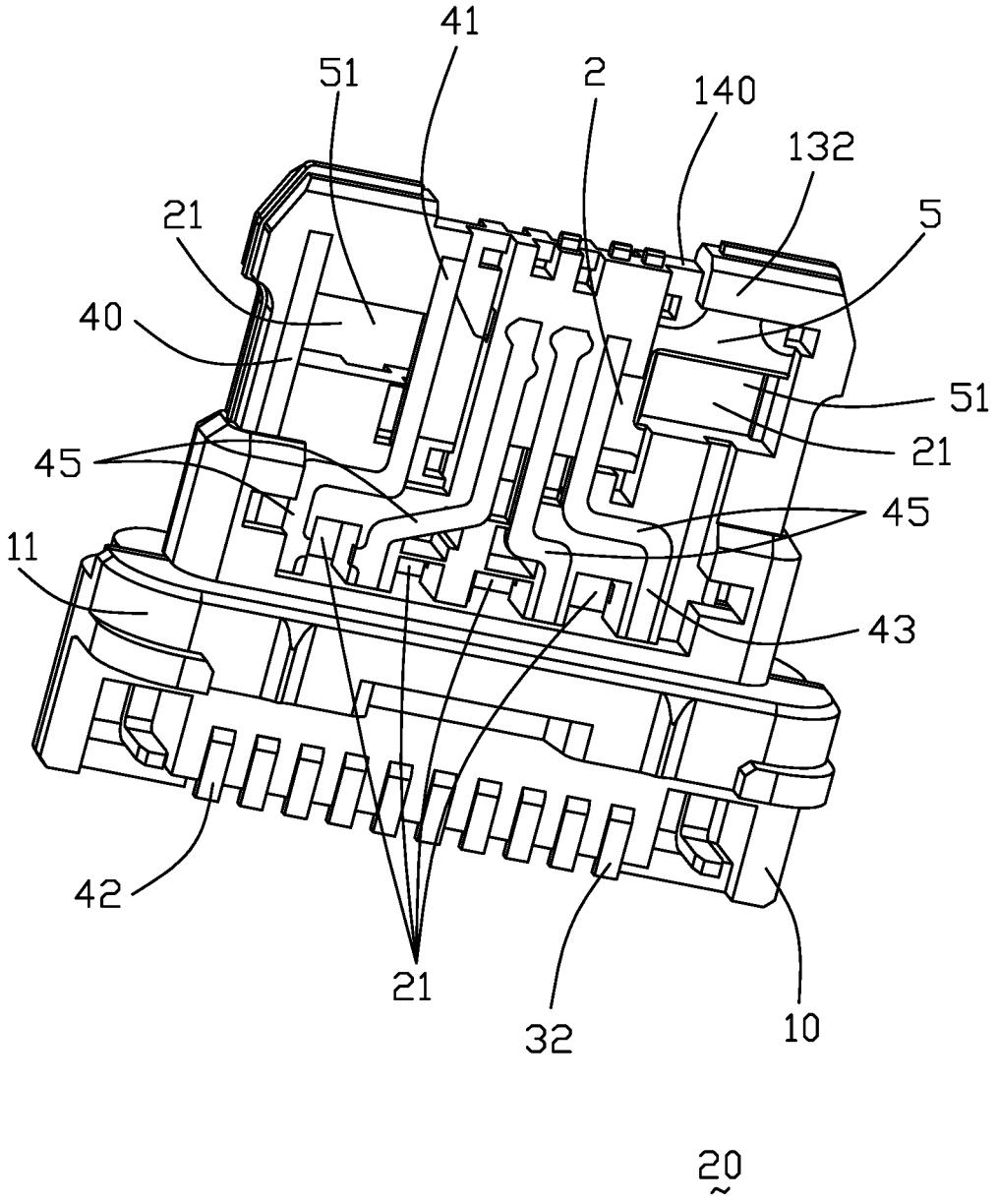
FIG. 6 is a view similar to FIG. 5, but viewed from another aspect.
Figure 7:
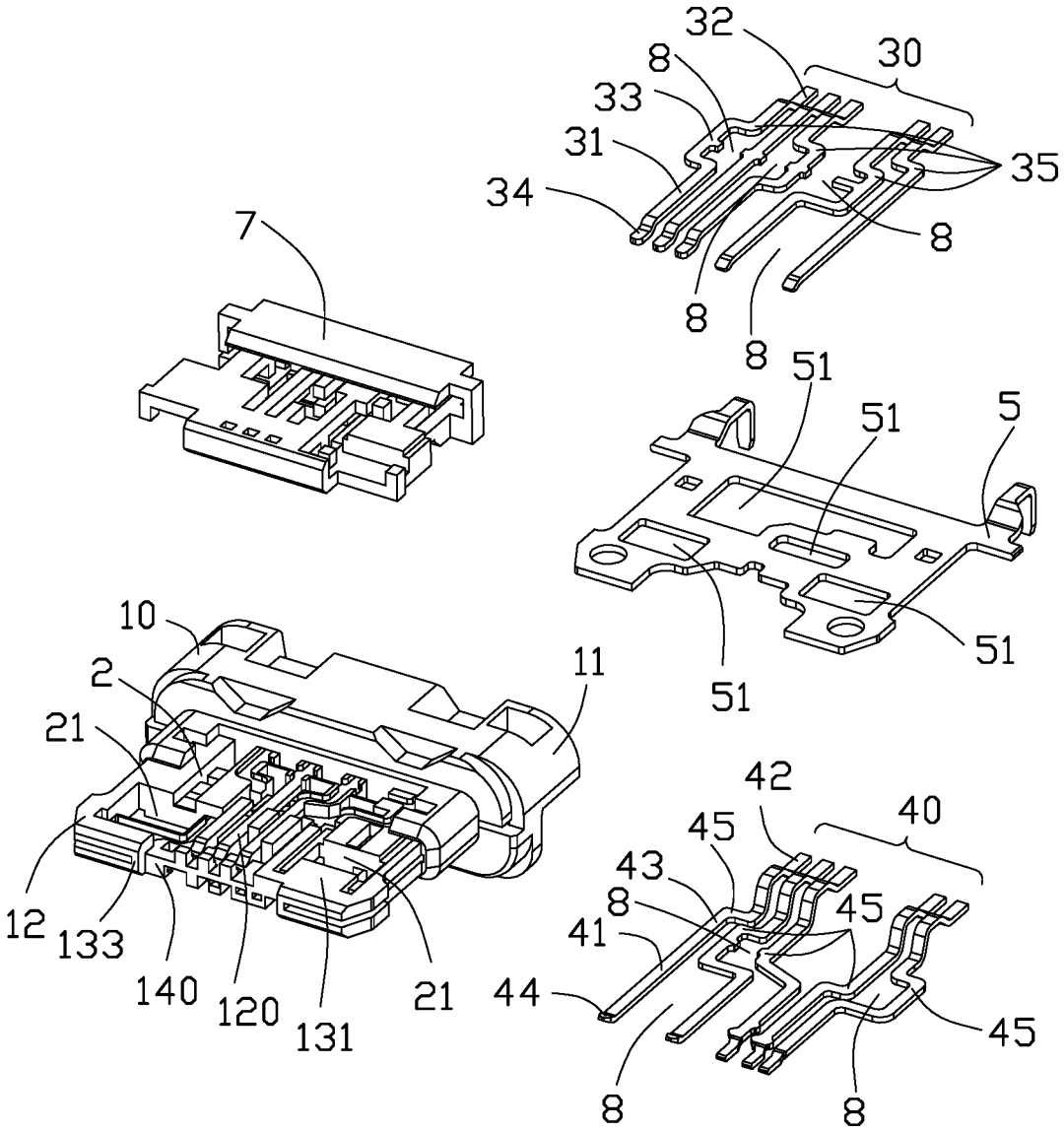
FIG. 7 is an exploded view of the connector shown in FIG. 1 omitting the metallic shell.
Figure 8:
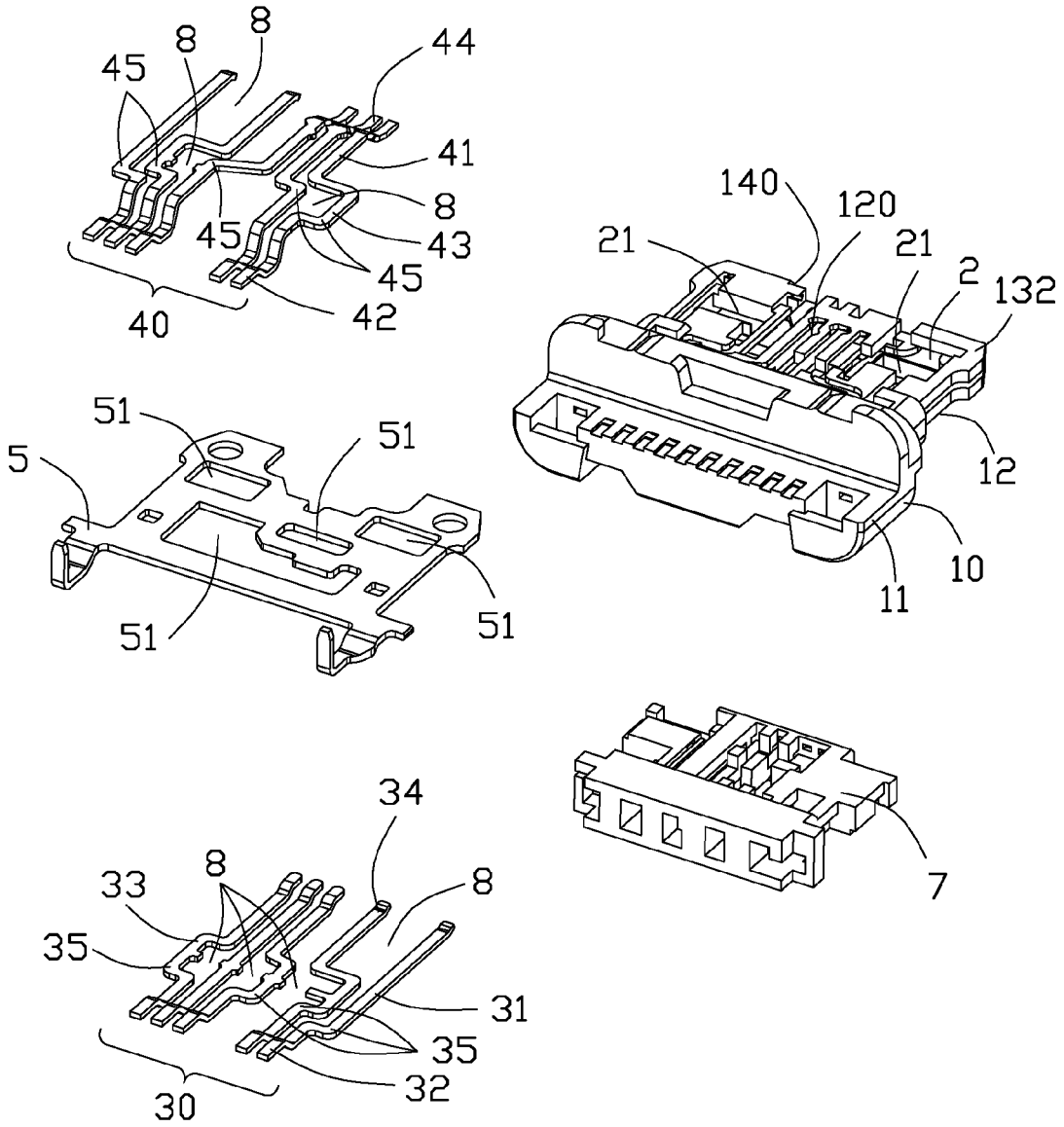
FIG. 8 is a view similar to FIG. 7, but viewed from another aspect.
Figure 9:
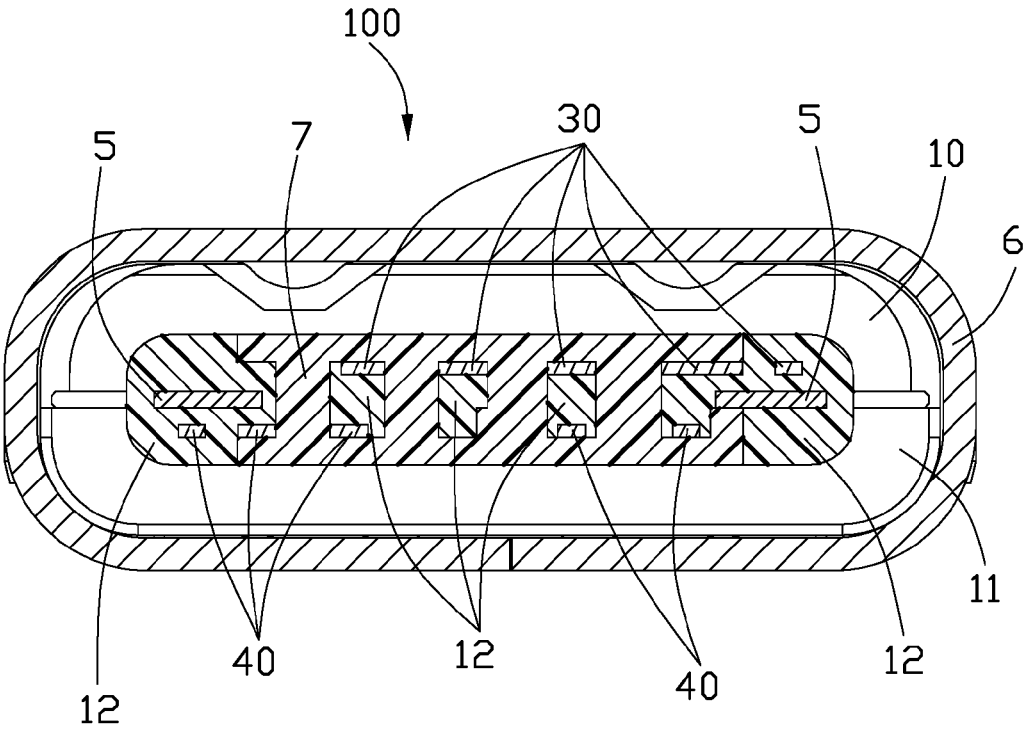
FIG. 9 is a cross-sectional view of the connector shown in FIG. 1 along line 9-9.
Figure 10:
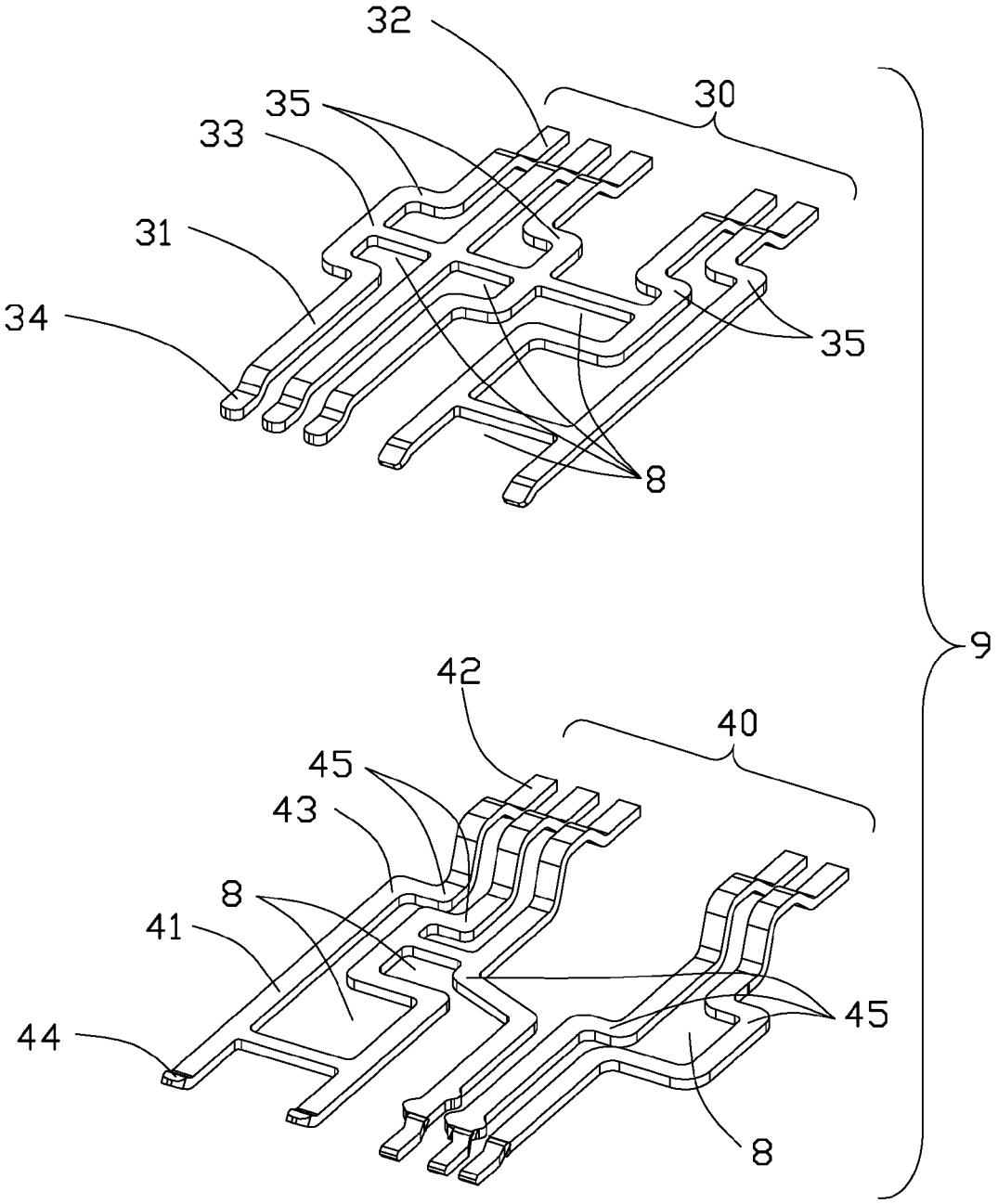
FIG. 10 is a perspective view of a plurality of contacts without removing beltings of the connector shown in FIG. 1.
Figure 11:
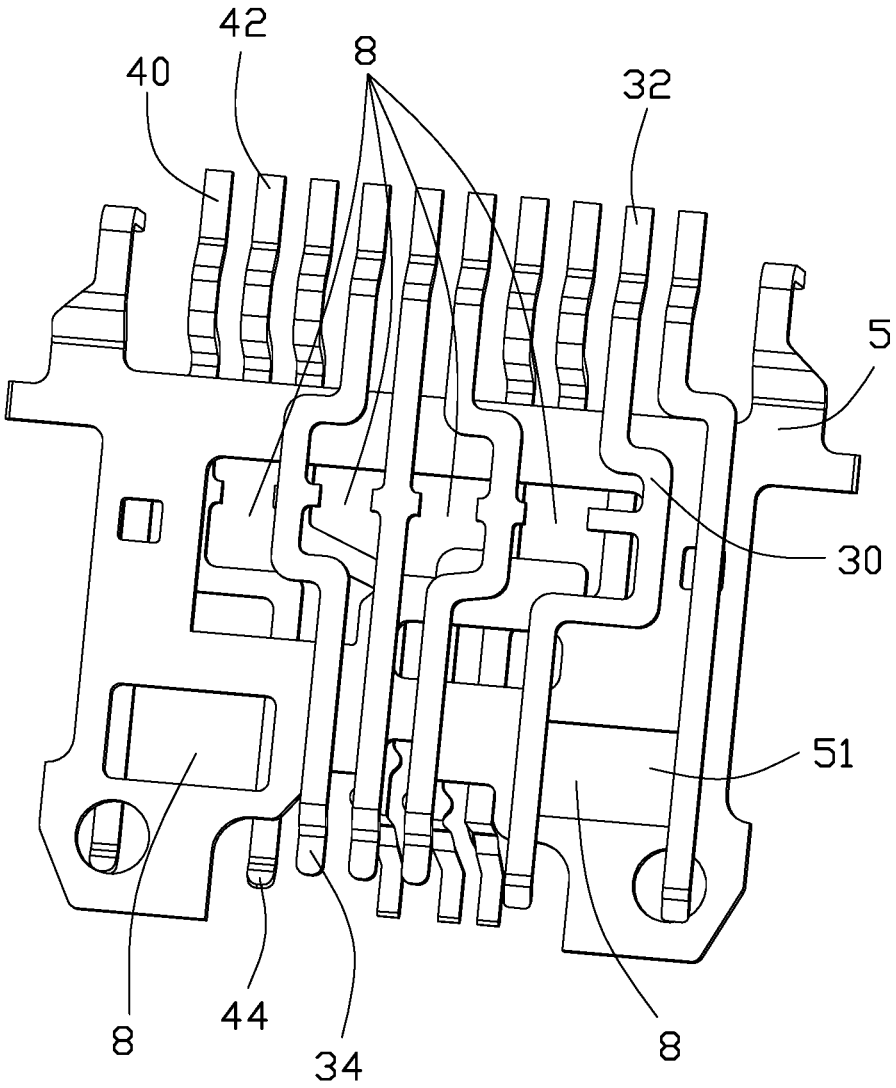
FIG. 11 is a perspective view of the connector shown in FIG. 5 omitting an insulative housing.
Figure 12:
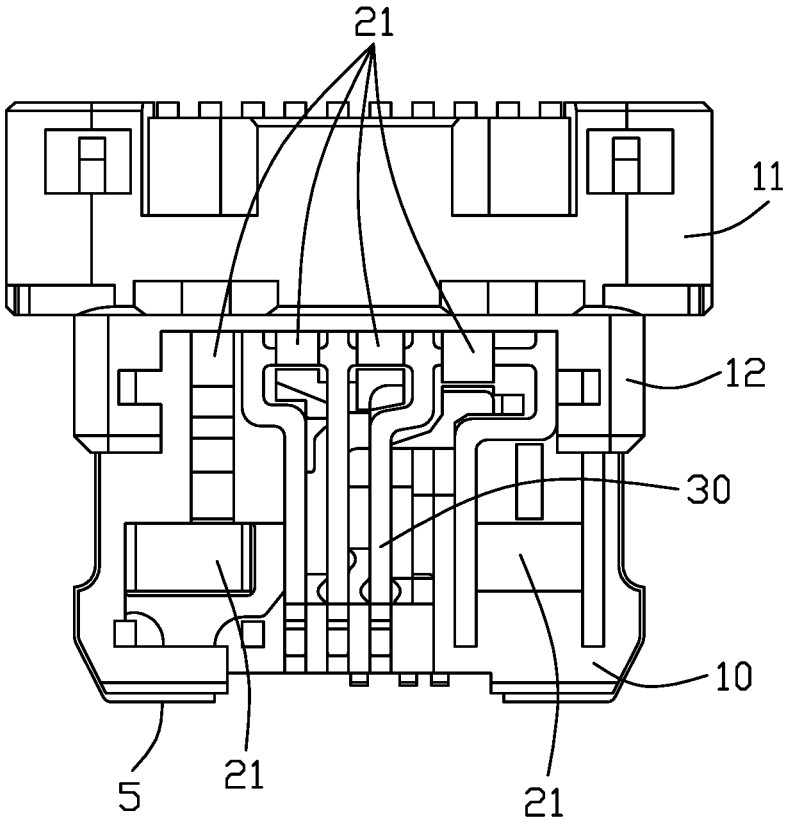
FIG. 12 is a vertical view of the connector shown in FIG. 1 omitting an metallic shell.

Each second contact 40 comprises a second engaging section 41 exposed on the lower surface 132, a second soldering section 42 exposed out of the rear end of the main portion 11, and a second connecting section 43 connecting the second engaging section 41 and the second soldering section 42. The second connecting section 43 comprises a second bending section 45 bent along a direction away from a contiguous second contact to form the enlarged gap 8 for increasing a distance between the two adjacent second contacts 40. Each second engaging section 41 comprises a second forestalling section 44 located in a front thereof and fixed in the tongue portion 12 for preventing the second contact 40 from warping. As shown in FIGS. 4 and 6, the first soldering sections 32 and the second soldering sections 42 are arranged on the rear end of the main portion 11 in a row.

As shown in FIGS. 7-8 and 11-12, the enlarged gap 8 between the two adjacent first contacts 30 corresponds with the corresponding enlarged gap 8 between the two adjacent second contacts 40 in an up-to-down direction perpendicular to an insertion direction. The enlarged gaps 8 between different two adjacent first contacts 30 are different in a horizontal direction perpendicular to the up-to-down direction. The enlarged gaps 8 between different two adjacent second contacts 40 are different in a horizontal direction perpendicular to the up-to-down direction.

As shown in FIGS. 5-9 and 11-12, the insulative housing 10, the first contacts 30, the second contacts 40, and the shielding plate 5 are molded to form the contact module 20 by insert-molding process. The cavities 2 are exposed on the upper surface 131 and the lower surface 132. The cavities 2 comprise a plurality of notches 140 concaved backwardly from the front surface 133, and a plurality of through holes 21 connecting with the two adjacent contact-receiving grooves 120 and corresponding with the enlarged gap 8. The notches 140 and the through holes 21 run through the upper surface 131 of the tongue portion 12 to the lower surface 132 of the tongue portion 12. The shielding plate 5 defines a plurality of openings 51, each opening 51 corresponding with the corresponding through hole 21 and the corresponding enlarged gap 8 in the up-to-down direction. The through holes 21, the corresponding openings 51, and the corresponding enlarged gaps 8 are connected together in the up-to-down direction.

As shown in FIGS. 3-9, the insulative member 7 is molded to the tongue portion 12 of the contact module 20 for sealing the cavities 2 by over-molding process. The insulative member 7 partially encloses the upper surface 131, the lower surface 132, the first forestalling section 34, the first connecting section 33, and the second connecting section 43.

As shown in FIGS. 1 to 12, a method of making an electrical connector 100 comprises the steps of: step 1: providing a shielding plate 5 and a plurality of contact beltings 9 having a plurality of contacts 3 and beltings, the contacts 3 comprising a plurality of first contacts, each contact comprising an engaging section, a soldering section and a connecting section connecting the engaging section and the soldering section, at least one connecting section of the first contacts comprising a first bending section bent along a direction away from the contiguous first contact to form an enlarged gap 8 for increasing a distance between the adjacent first contacts; step 2: insert molding an insulative housing 10 with the contacts 3 and shielding plate 5, the insulative housing 10 comprising a base portion 11, a tongue portion 12 extending forwardly from the base portion 11 along an insertion direction, a plurality of cavities 2 extending through the tongue portion 12 in an up-to-down direction perpendicular to the insertion direction and a plurality of contact-receiving grooves 120, the cavities 2 comprising a plurality of through holes 21 connecting with the adjacent contact-receiving grooves 120, the beltings exposed in the through holes 21 partially, and the shielding plate 5 defining a plurality of openings 51 corresponding with the through holes 21 and the enlarged gaps 8; step 3: removing the beltings or linkages exposed in the through holes 21 by stamping process; step 4: over molding or insert-molding an insulative member 7 to the tongue portion 12 for sealing the cavities 2; step 5: assembling a metallic shell 6 to enclose the insulative housing 10 and the contacts 3. In the step of providing the contact beltings, the contacts comprise a plurality of second contacts, at least one connecting section of the second contacts comprises a second bending section bent along a direction away from the contiguous second contact to form an enlarged gap for increasing a distance between the adjacent second contacts.

In the present invention, the through hole 21 correspond with the enlarged gap 8 in the up-to-down direction and connect with the two adjacent contact-receiving grooves 120, so as to remove the beltings 9 exposed in the through holes 21. The insulative housing 7 seals the cavities 2 for avoiding a foreign body entering into the through holes 21 and causing the first contacts 30 and the second contacts 40 to short-circuit. The important feature of the instant invention is to have the upper row contacts 30 and the lower row contacts 40 and the shielding plate 5 are simultaneously insert-molded within the housing 10 via the first insert-molding process to form a contact module 20, and the insulative member 7 is successively attached to the contact module 20 via a second insert-molding process for completeness of the connector. One key issue to implement the first insert-molding process is to have each of the upper row contacts 30 and each of the lower row contacts 40 have corresponding portions exposed to the exterior both downwardly and upwardly for allow the corresponding molds to press thereon for reliable positioning the corresponding contacts during the insert-molding process. Under this requirement, some forestalling sections 44 of the second contacts 40 are originally aligned with each other in the vertical direction while being intentionally offset sidewardly so as to avoid being aligned with the forestalling sections 34 of the first contacts in the vertical direction. Similarly, the bending sections 45 and the bending sections 35 are intentionally offset sidewardly for avoid being aligned with each other in the vertical direction. Notably, the shielding plate 5 requires openings 51 for allow corresponding molds to extend therethrough during the first insert-molding process from one side of the shielding plate to the other side for pressing against the contacts on the other side.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector comprising:

an insulative housing comprising a base portion, a tongue portion extending forwardly from the base portion along an insertion direction, a plurality of cavities extending through the tongue portion in an up-to-down direction perpendicular to the insertion direction, and a plurality of contact-receiving grooves, the cavities comprising a plurality of through holes connecting with the adjacent contact-receiving grooves;

a plurality of contacts comprising a plurality of first contacts accommodated in the contact-receiving grooves, each of the plurality of contacts comprising an engaging section, a soldering section, and a connecting section connecting the engaging section and the soldering section, at least one connecting section of the first contacts comprising a first bending section bent along a direction away from the contiguous first contact to form an enlarged gap for increasing a distance between corresponding adjacent first contacts;

a shielding plate accommodated in the insulative housing; and a metallic shell enclosing the insulative housing;

wherein the insulative housing, the shielding plate, and the contacts are insert-molded to form a contact module, and the enlarged gap and corresponding through hole are connected together in the up-to-down direction.

2. The electrical connector as claimed in claim 1, further comprising an insulative member attached to the contact module for sealing the cavities, and the insulative member is over-molded to the tongue portion.

3. The electrical connector as claimed in claim 2, wherein the shielding plate defines a plurality of openings corresponding to the through holes and the enlarged gaps.

4. The electrical connector as claimed in claim 3, wherein the tongue portion defines an upper surface, a lower surface and a front surface, the cavities further comprising a plurality of notches concaved backwardly from the front surface, and the notches and the through holes run through the upper surface and the tongue portion to the lower surface.

5. The electrical connector as claimed in claim 4, wherein the insulative member partially encloses the upper surface and the lower surface for sealing the notches and the through holes.

6. The electrical connector as claimed in claim 1, wherein the contacts further comprise a plurality of second contacts.

7. The electrical connector as claimed in claim 6, wherein at least one connecting section of the second contacts comprises a second bending section bent along a direction away from the contiguous second contact to form an enlarged gap for increasing a distance between the two adjacent second contacts.

8. The electrical connector as claimed in claim 6, wherein the engaging sections of the first contacts and the second contacts are positioned on the upper surface and the lower surface correspondingly for normally and reversely mating with a mating connector, and the soldering sections of the first contacts and the second contacts are arranged in a row.

9. An electrical connector comprising:

a metallic shell;

an insulative housing enclosed in the metallic shell and including a main portion and a tongue portion extending forwardly from the main portion along a front-to-back direction, said tongue portion defining opposite upper and lower surfaces in a vertical direction perpendicular to said front-to-back direction;

a plurality of first contacts arranged in one row along a transverse direction perpendicular to both said front-to-back direction and said vertical direction, each of said first contacts including a first engaging section exposed upon the upper surface, a first soldering section exposed outside of the housing, and a first connecting section linked between the first engaging section and the first soldering section;

a plurality of second contacts arranged along the transverse direction, each of said second contacts including a second engaging section exposed upon the lower surface, a second soldering section exposed outside of the housing, and a second connecting section linked between the second engaging section and the second soldering section;

a metallic shielding plate embedded within the tongue portion and located between the first engaging sections and the second engaging sections; and in some of said first contacts, the corresponding first engaging sections adjacent to one another with a first pitch therebetween while the corresponding first connecting sections adjacent to one another with therebetween a second pitch larger than the first pitch; wherein the first connecting sections are originally provided with beltings linked between the neighboring second contacts, and the shielding plate includes openings aligned with said beltings in the vertical direction so as to allow removal of said beltings after both the first contacts and the second contacts are integrally formed with the insulative housing via an insert-molding process to commonly form a contact module.

10. The electrical connector as claimed in claim 9, wherein said housing forms a plurality of through holes in alignment with the beltings so as to allow removal of said beltings after the contact module is formed.

11. The electrical connector as claimed in claim 10, further including an insulative member overmolded upon the contact module to fill the through holes and complete both the first surface and the second surface.

12. The electrical connector as claimed in claim 9, wherein front ends of the first engaging sections are hidden behind a front end of the tongue portion while those of the second engaging sections forwardly extend beyond the front edge of tongue portion.

13. The electrical connector as claimed in claim 12, further including an insulative member overmolded upon the housing to enclose the front ends of the second engaging sections.

14. The electrical connector as claimed in claim 9, wherein all said first soldering sections and said second soldering sections are arranged in one line along the transverse direction.

15. An electrical connector comprising:

a metallic shell;

an insulative housing enclosed in the metallic shell and including a main portion and a tongue portion extending forwardly from the main portion along a front-to-back direction, said tongue portion defining opposite upper and lower surfaces in a vertical direction perpendicular to said front-to-back direction;

a plurality of first contacts arranged in one row along a transverse direction perpendicular to both said front-to-back direction and said vertical direction, each of said first contacts including a first engaging section exposed upon the upper surface, a first soldering section exposed outside of the housing, and a first connecting section linked between the first engaging section and the first soldering section;

a plurality of second contacts arranged along the transverse direction, each of said second contacts including a second engaging section exposed upon the lower surface, a second soldering section exposed outside of the housing, and a second connecting section linked between the second engaging section and the second soldering section;

a metallic shielding plate embedded within the tongue portion and located between the first engaging sections and the second engaging sections;

some of the neighboring first contacts being linked with one another by a first set of beltings in the transverse direction; and some of the neighboring second contacts being linked with one another by a second set of beltings in the transverse direction; wherein the first set of beltings and the second set of beltings are not aligned with each other in the vertical direction but aligned with corresponding openings in the shielding plate so as to allow removal of said first set of beltings and said second set of beltings after both the first contacts and the second contacts are integrally formed with the insulative housing via an insert-molding process to commonly form a contact module.

16. The electrical connector as claimed in claim 15, wherein said housing forms a plurality of through holes in alignment with the beltings so as to allow removal of said beltings after the contact module is formed.

17. The electrical connector as claimed in claim 16, further including an insulative member overmolded upon the housing to complete the first surface and the second surface, and fill said through holes and optionally even the openings.

18. The electrical connector as claimed in claim 15, wherein said first set of beltings link the corresponding first connecting sections rather than the first engaging sections.

* * * * *